US011454016B2

(12) United States Patent
Nygård

(10) Patent No.: US 11,454,016 B2
(45) Date of Patent: Sep. 27, 2022

(54) DRAIN, METHOD FOR INSTALLING A DRAIN, AND A KIT OF PARTS FOR INSTALLING A DRAIN

(71) Applicant: Thomas Nygård, Trondheim (NO)

(72) Inventor: Thomas Nygård, Trondheim (NO)

(73) Assignee: Thomas Nygård, Trondheim (NO)

( * ) Notice: Subject to any disclaimer, the term of this patent is extended or adjusted under 35 U.S.C. 154(b) by 842 days.

(21) Appl. No.: 16/338,922

(22) PCT Filed: Oct. 2, 2017

(86) PCT No.: PCT/NO2017/050256
§ 371 (c)(1),
(2) Date: Apr. 2, 2019

(87) PCT Pub. No.: WO2018/067015
PCT Pub. Date: Apr. 12, 2018

(65) Prior Publication Data

US 2021/0285201 A1 Sep. 16, 2021

(30) Foreign Application Priority Data

Oct. 3, 2016 (NO) ..... 20161586
Jan. 23, 2017 (NO) ..... 20170096

(51) Int. Cl.
*E03F 5/04* (2006.01)
*E04G 15/06* (2006.01)

(52) U.S. Cl.
CPC ..... *E03F 5/0407* (2013.01); *E04G 15/068* (2013.01); *E03F 2005/0413* (2013.01); *E03F 2005/0418* (2013.01)

(58) Field of Classification Search
CPC ..... E03F 5/0407; E03F 2005/0413; E03F 2005/0418; E04G 15/068
See application file for complete search history.

(56) References Cited

U.S. PATENT DOCUMENTS 2,095,024 A * 10/1937 Boosey ..... E03F 5/0407 210/300
4,263,138 A * 4/1981 Kessel ..... E03F 5/0407 137/247.27

(Continued)

FOREIGN PATENT DOCUMENTS

DE 20311666 1/2005
DE 102009031844 1/2010

(Continued)

OTHER PUBLICATIONS

Norwegian Search Report, Norwegian Patent Application No. 20170096, dated Aug. 23, 2017.

(Continued)

*Primary Examiner* — Kevin F Murphy
(74) *Attorney, Agent, or Firm* — Andrus Intellectual Property Law, LLP

(57) ABSTRACT

A drain has a cup with a fluid outlet to be connected to a conduit, wherein the cup accommodates a water trap. The cup has an axial channel along the circumference, the channel is open upwards and limited by a bottom, a channel wall and a cup wall. The drain further has a circumferential drain wall adapted to fit into the channel, whereby the drain wall is arranged axially movable in the channel, a casting framework arranged releasable around the outer circumference of the drain wall, the framework has a radial extension, and the drain wall has an outward radial flange at an upper end, the radial extension of the flange is equal or less than the radial extension of the framework. A method and a kit of parts for installing such a drain are also disclosed.

10 Claims, 2 Drawing Sheets

(56) References Cited

U.S. PATENT DOCUMENTS

| | | | | |
|---|---|---|---|---|
| 4,883,590 | A | 11/1989 | Papp | |
| 7,735,512 | B1 | 6/2010 | Ismert et al. | |
| 9,428,900 | B2 * | 8/2016 | Wroblewski ..... | E03F 5/0407 |
| 2015/0292662 | A1 | 10/2015 | Majocka et al. | |

FOREIGN PATENT DOCUMENTS

| | | |
|---|---|---|
| EP | 3031990 | 6/2016 |
| FR | 2841918 | 1/2004 |
| FR | 2949491 | 3/2004 |
| NO | 177505 | 6/1995 |
| WO | 2001/023680 | 4/2001 |

OTHER PUBLICATIONS

International Search Report, PCT/NO2017/050256, dated Feb. 12, 2018.
Written Opinion, PCT/NO2017/050256, dated Feb. 12, 2018.

* cited by examiner

DRAIN, METHOD FOR INSTALLING A DRAIN, AND A KIT OF PARTS FOR INSTALLING A DRAIN

CROSS REFERENCE TO RELATED APPLICATIONS

This application is the U.S. national stage application of International Application PCT/NO2017/050256, filed Oct. 2, 2017, which international application was published on Apr. 12, 2018, as International Publication WO 2018/067015 in the English language. The International Application claims priority of Norwegian Patent Application No. 20161586, filed Oct. 3, 2016 and Norwegian Patent Application No. 20170096, filed Jan. 23, 2017. The international application and Norwegian applications are all incorporated herein by reference, in entirety.

FIELD

The present invention is related to a drain and a method for installing such a drain in concrete slabs or floors. The invention also relates to a kit of parts for installing a drain.

BACKGROUND

When constructing or renovating buildings, a drain must often be installed before the floor is completed. This is especially a problem related to concrete floors or floors having a casted top layer, as the final level of the floor is not known when the drain must be installed. Typically, the drains are installed and connected to a conduit such as a sewage pipe prior to pouring the surrounding concrete. Ideally, the drain is installed at the proper height to allow for proper drainage and so that the grate of the drain will be flush with the finished floor surface.

Additional problems can arise when a layer of tiles or other flooring material is installed on top of the concrete. In such instances, the plumber typically installs the drains so that the top surface will extend above the level of the concrete in a distance equal to the thickness of the flooring. Unfortunately, it is not uncommon for concrete crews to mistakenly pour the slab to the top of the drains instead of the specified lower level, thereby creating the need for further upward adjustment of the drains. Such adjustment is often not provided for by the drain. In other cases the level of the concrete pour is too low, and thus the drain will raise above the finished floor.

In either case, once the concrete poured around the drains has set, it is not possible to raise or lower the drain without chipping away the concrete surrounding the drain to provide clearance for lugs usually formed on the bottom of the drain head and to break the adhesion between the concrete and the drain head surface. Corresponding problems arise if the building owner later decides to add a layer of flooring over the slab or to substitute existing flooring with a thicker layer, it is usually impossible to raise the drain to the higher level without first chipping or breaking away the concrete from around the drain head.

Further, there is a need to make the concrete floor water resistant, usually by means of a membrane. According to Norwegian wet room standards, a flexible sealing membrane or drain membrane must be used in the area around the drain. It is a well known problem that the membrane may get punctured due to tear and uneven floor in the area of the drain, and most water damages to wetrooms are caused by such punctures.

It is thus a need for a drain and a method for installing such a drain which provides for easy installation and a possibility for later height adjustment. Further, there is a need for an improved and easy installation of membranes in areas around the drain, without the above said disadvantages.

SUMMARY

The above said problems are solved by a drain, a method and a kit of parts for installing such a drain, according to the present disclosure.

The invention relates to a drain comprising a cup with a fluid outlet to be connected to a conduit, preferably a part of a sewage system. The cup is designed to accommodate a water trap, and comprises further an axial channel along the circumference of the cup. The channel is open upwards and limited by a bottom, a channel wall and a cup wall. The drain further comprises a circumferential drain wall adapted to fit into the channel, whereby the drain wall is arranged to be axially movable in the channel. A casting framework is arranged releasable around the outer circumference of the drain wall, the framework has a radial extension, and the drain wall has an outward radial flange at an upper end. The radial extension of the flange is equal or less than the radial extension of the framework on the sleeve.

The invention also relates to a drain comprising a cup with a fluid outlet to be connected to a conduit, preferably a part of a sewage system. The cup is designed to accommodate a water trap, and comprises further an axial channel along the circumference of the cup. The channel is open upwards and limited by a bottom, a channel wall and a cup wall. The drain further comprises a removable circumferential sleeve adapted to fit into the channel, whereby the sleeve is arranged axially movable in the channel and protrudes above the cup and beyond the expected level of the floor wherein the drain is installed. A casting framework is arranged around the outer circumference of the sleeve, the framework has a radial extension. The drain further comprises a circumferential drain wall adapted to fit into the channel, whereby the drain wall is arranged axially movable in the channel. The drain wall has an outward radial flange at an upper end, the radial extension of the flange is equal or less than the radial extension of the framework.

A drain according to the invention comprises a cup with a fluid outlet to be connected to a conduit which preferably a part of a sewage system. The cup is designed to accommodate a water trap, and comprises further an axial channel along the circumference of the cup. The channel is open upwards and limited by a bottom, a channel wall and a cup wall. The drain further comprises a circumferential drain wall adapted to fit into the channel, whereby the drain wall is arranged to be axially movable in the channel. The drain may further comprises a removable circumferential sleeve adapted to fit into the channel, whereby the sleeve is arranged axially movable in the channel and protrudes above the cup and beyond the expected level of the floor wherein the drain is installed. A casting framework is arranged releasable around the outer circumference of the sleeve if the drain comprises a sleeve, and the drain wall, if the drain does not comprise a sleeve.

The framework has a radial extension, and the drain wall has an outward radial flange at an upper end. The radial extension of the flange is equal or less than the radial extension of the framework on the sleeve.

Said in another way, the invention relates to a drain as described above which may comprise a sleeve which is only used during casting, and removed once the casted floor is cured. If a sleeve is used, then the framework should be arranged around the sleeve, if a sleeve is not used, then the framework should be arranged around the drain wall.

In a preferred embodiment, the drain wall is arranged moveable between a first position wherein it protrudes above the cup and above an expected level of the floor where the drain is installed, and a second position wherein an upper face of the flange of the drain wall is aligned with the expected level of the floor.

In a preferred embodiment, the framework is movable axially along the drain wall or sleeve. The radial extension of the framework and the radial flange of the drain wall is preferably planar, such as perpendicular to the wall or sleeve. In an alternative embodiment, the radial extension of the framework and the radial flange may be angular to the wall or sleeve creating a slope towards the drain. The angle between the wall or sleeve and the radial extension of the framework should be the same as the angle between the wall and the radial flange.

In a preferred embodiment, the radius diameter of an upper part of the sleeve is larger than the diameter of the drain wall, the diameter of a lower part of the sleeve should be equal to the diameter of the drain wall in order to fit into the channel. The upper part of the sleeve is the part of the sleeve protruding above the axial channel, and the lower part is the part inserted into the axial channel. The upper part of the sleeve may then not fit into the channel, and only the lower part of the sleeve will be moveable in the channel. When the diameter of the upper part is larger than the diameter of the drain wall, there will be an annulus between the layer of concrete casted around the drain when the sleeve is inserted into the channel, and the drain wall when the drain wall is inserted into the channel. This space may be used for adjusting the drain wall when installing it into the axial channel, for instance if the concrete floor is not sloping as expected.

Further, if the outer diameter of the drain wall is less than the inner diameter of the upper part of the sleeve, the drain wall may be inserted into the sleeve, which will be an advantage during storage and transportation. In an alternative embodiment, it is also possible to store the drain wall inside the sleeve even during casting of the concrete layer or floor.

In a preferred embodiment, the drain also comprises a membrane, preferably a foldable, flexible membrane, attached to an upper face of the radial flange of the drain wall. When the drain is installed, and the membrane conveniently arranged, the membrane extends beyond the flange and covers an area around the drain. The membrane will then satisfy the Norwegian standards for a wet room.

In a preferred embodiment, the cup has an inner flange or horizontal face which the water trap may bear against. The water trap will thus be arranged correctly in the cup, and a sealing should preferably be arranged between the cup and the water trap in order to prevent smell and leakage from the sewage system.

In order to prevent the sleeve and drain wall to slide unintentionally down into the axial channel, the width of the channel may reflect the thickness of the sleeve and/or drain wall respectively. In a preferred embodiment, there are arranged seals between the axial channel and the inserted part. The issues relating to sealings may be solved in a number of other ways, which will be obvious to a person skilled in the art.

In an alternative embodiment, the channel wall is slanting radially outwardly towards the cup wall, in such a way that the channel is wider at the bottom than at the top. In another alternative embodiment, the channel wall and cup wall may be parallel, but there is an intermediate wall in the channel, fastened in a lower end to the channel wall wherein the intermediate wall runs upwards and radially towards the cup wall until it bears against the sleeve or drain wall respectively. With this intermediate wall, the axial channel may be wider at the bottom and the installation of the seals will be easier. The intermediate wall may further be of a flexible or resilient material, wherein the intermediate wall may be biased when the sleeve or drain wall is inserted into the channel and press the sleeve or drain wall towards the cup wall.

A drain according to the present invention may be installed on a floor, such as a wooden floor, where a top layer should be casted. It may also be installed directly on the ground where a cement floor should be casted. In embodiments to be installed in an existing floor, the cup may preferably comprise a radial flange at its upper end, the flange is to be fastened to the floor which the layer should be casted upon. The preferred casted top layer is a concrete layer.

The invention also relates to a method for installing a drain as defined above. The method comprises steps for a. arranging the cup at the desired place for the drain, and connecting the outlet to a conduit, b. inserting the drain wall into the axial channel until the wall protrudes above the expected level of the floor, c. arranging the framework around the circumference of the drain wall, d. casting the floor, e. sliding down the drain wall until a lower part of the radial extension of the framework is below the surface of the casted floor, f. once the floor is cured, removing the framework from drain wall, the framework will leave a circumferential recess in the casted floor, g. moving the drain wall axially into the axial channel until the radial flange of the drain wall rests upon the circumferential recess.

The invention also relates to an alternative method for installing a drain having a sleeve as defined above. The method comprises steps for a. arranging the cup at the desired place for the drain, and connecting the outlet to a conduit, b. inserting the sleeve into the axial channel, the sleeve protrudes above the expected level of the floor, c. arranging the framework around the circumference of the sleeve, d. casting the floor, e. sliding down the sleeve or framework until a lower part of the radial extension of the framework is below the surface of the casted floor, f. once the floor is cured, removing the sleeve and framework from drain, the framework will leave a circumferential recess in the casted floor, g. inserting the drain wall into the axial channel until the radial flange of the drain wall rests upon the circumferential recess.

The invention relates to methods for installing both drains being described above. If the drain comprises a sleeve, then the then the framework should be arranged around the sleeve, the sleeve and framework should be removed once the floor is cured, and the drain wall is installed in the axial channel. If a sleeve is not used, then the framework should be arranged around the drain wall, and removed once the floor is cured.

If there is a floor or other material arranged at the installation place for the drain, before the layer is casted, the methods should also comprise a step for fastening a radial flange of the cup to the floor or material which the concrete is to be casted upon.

If the framework is arranged axially moveable on the sleeve or drain wall, only the framework and not the sleeve or drain wall may be moved in step e.

In an alternative embodiment, the framework is adjusted to a given level before the floor is casted, then the level of concrete is adjusted to the correct level according to the framework.

In a preferred embodiment, the method also comprises a step for applying a membrane on an upper face of the radial flange of the drain wall, and the surrounding casted floor.

The invention also comprises a kit of parts for installing a drain in casted floors or floors having an upper casted layer. The kit of parts comprises a cup with a fluid outlet to be connected to a conduit. The conduit is preferably a part of a sewage system in a building. The cup accommodates a water trap, the water trap may be of any appropriate kind. The cup further comprises an axial channel along the circumference, whereby the channel is open upwards and is limited by a bottom, a channel wall and a cup wall. The drain further comprises

- a removable circumferential sleeve fitting into the channel, wherein the sleeve is inserted into the channel during casting of the floor, and protrudes above the cup and beyond the expected level of the concrete floor wherein the drain is to be installed,
- a casting framework arranged around the outer circumference of the sleeve, the framework has a radial extension and is movable axially along the sleeve, and
- a drain wall for replacing the sleeve in the channel once the floor is casted, the drain wall has an outward radial flange at an upper end, the radial extension of the flange is equal or less than the radial extension of the framework on the sleeve.

The drain wall may be arranged axially moveable in the channel.

Example

The invention will now be described with the help of the enclosed figures, showing a drain according to the present invention. The different parts of the figure are not necessarily in scale to each other, as the figure is merely for illustrating the invention.

The following description of an exemplary embodiment refers to the drawing, and the following detailed description is not meant or intended to limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

BRIEF DESCRIPTION OF THE DRAWINGS

The invention will in the following be described with reference to the enclosed figures, where.

DETAILED DESCRIPTION OF THE DRAWINGS

Figure 1:
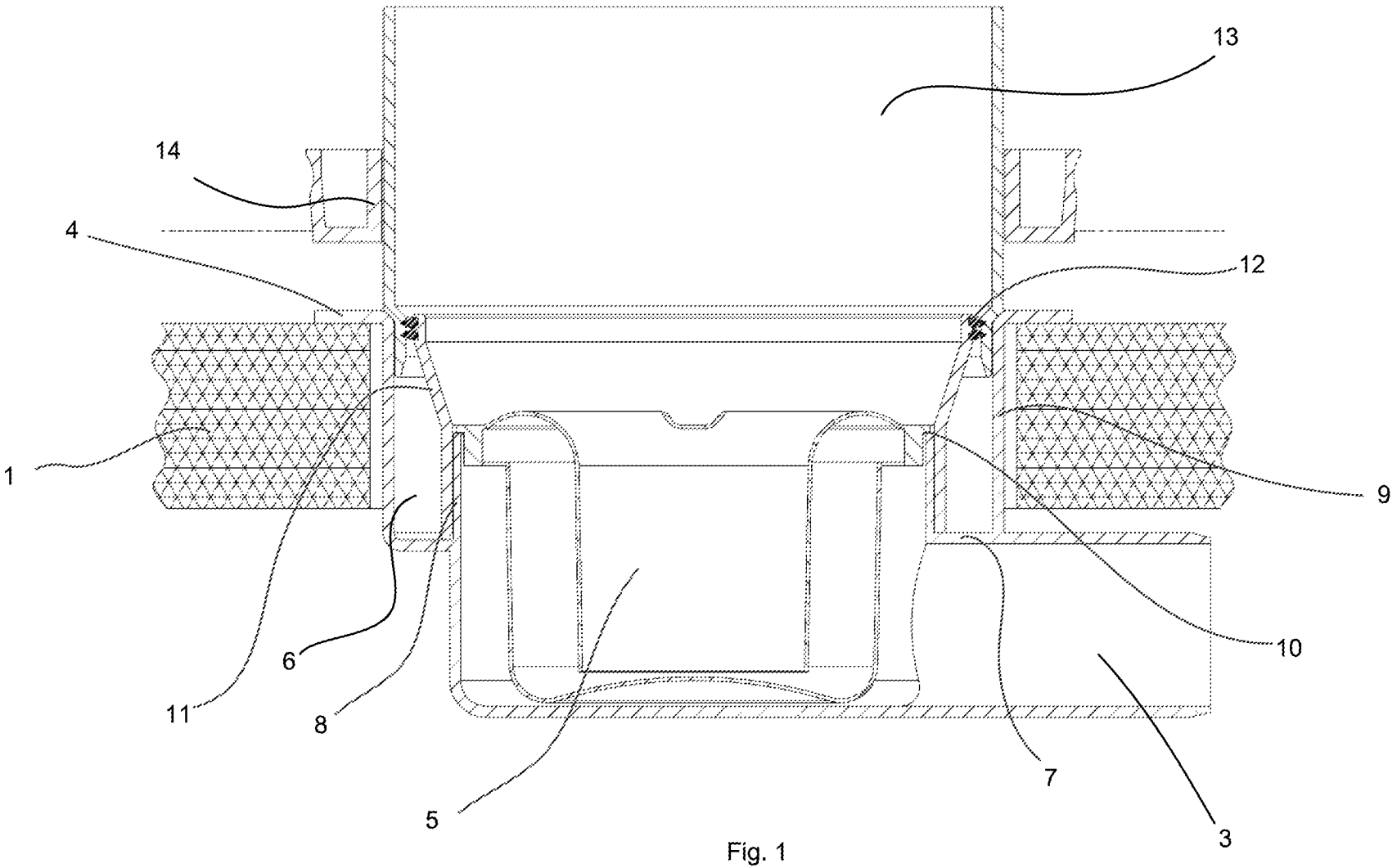
FIG. 1 shows a cross section of a drain having a sleeve.
Figure 2:
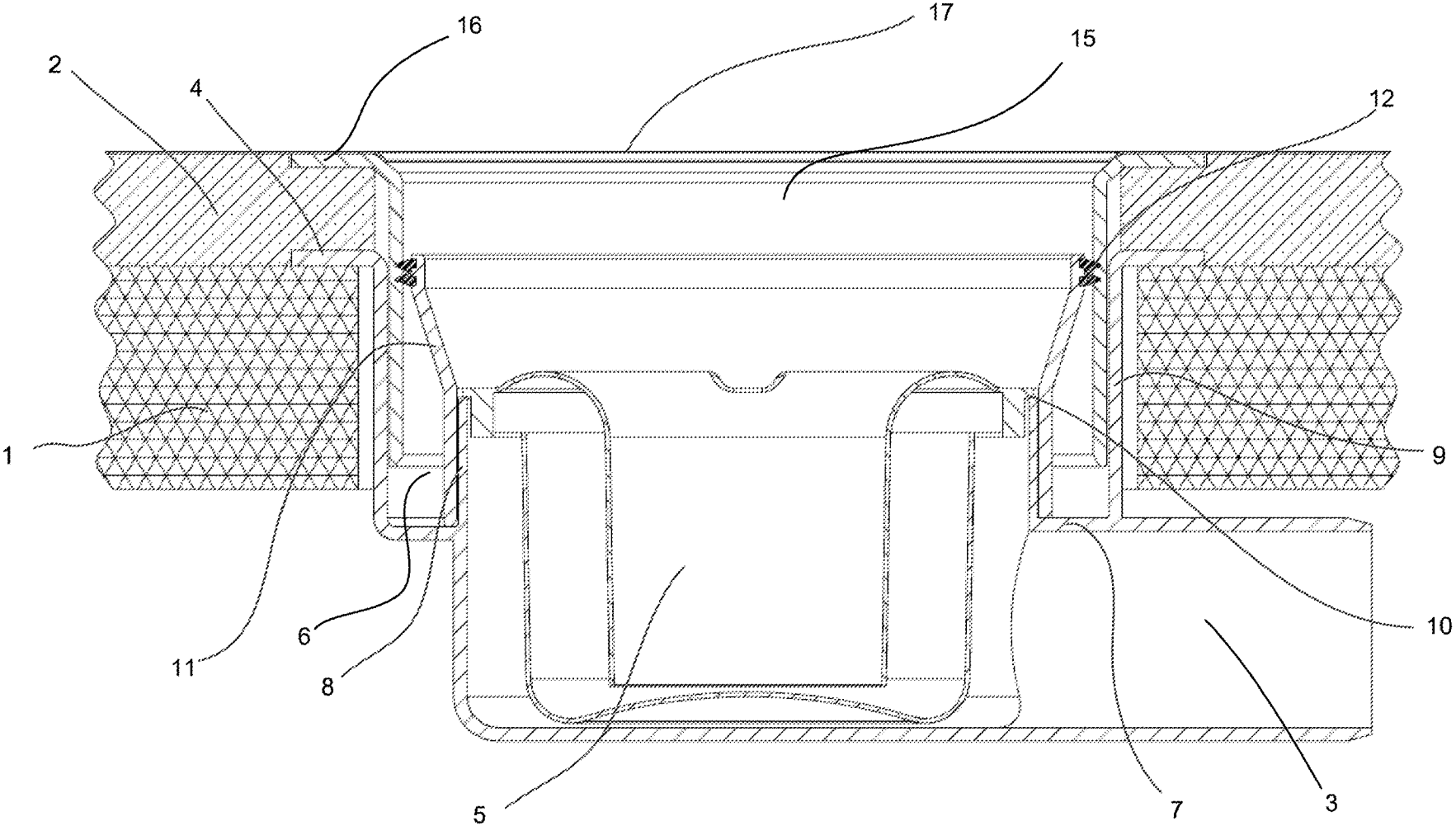
FIG. 2 shows a cross section of the drain shown in FIG. 1, where the sleeve is replaced by a drain wall.

FIGS. 1 and 2 both show a drain according to the invention, wherein the drain is installed in a wooden floor 1 in FIG. 1, and a layer of concrete 2 is casted upon the wooden floor 1 in FIG. 2. The drain comprises a cylindrical cup with a fluid outlet 3 to be connected to a conduit, and a radial flange 4 at its upper end, the radial flange 4 is fastened to the wooden floor 1. The drain accommodates a water trap 5 to prevent fluids from the sewage system to enter the room where the drain is installed.

The cup has two parts, where in the radius of a lower part is smaller than a radius of an upper part, the lower part accommodates the water trap 5. The upper part has an axial channel 6 along the circumference. The channel 6 is limited by a bottom 7, an inner channel wall 8 and an outer cup wall 9, and is open upwards. In the shown preferred embodiment, the outer wall of the cup is stepped between the upper and lower part, wherein the width of the bottom of channel 6 corresponds to the increase of the radius of the upper part of the cup.

In the shown embodiment, the inner channel wall 8 is an extension of the cup wall in the lower part of the cup, leaving the inner part of the drain cylindrically. The inner channel wall 8 ends with a horizontal face 10, and the water trap is bearing against this face 10. The water trap 5 is preferably provided with a sealing towards the face 10 and/or the inside of the inner channel wall 8. The sealings are not shown in the figures.

In the shown embodiment, a circumferential intermediate wall 11 is arranged in the channel 6, wherein the radius of the intermediate wall 11 is constant in a lower part, and gradually increasing in an upper part. The wall 11 is fastened to the channel wall 8 in the lower part, and protrudes upwards and radially outwards towards the cup wall 9. The intermediate wall 11 is provided with sealings 12 on the side facing the cup wall 9. In the shown embodiment, the upper edge of the intermediate wall is at the same level as the flange 4 of the cup.

In FIG. 1 the drain is shown with a sleeve 13 inserted into the channel 6, and a framework 14 arranged around the sleeve 13. The sleeve 13 is inserted into the channel 6 between the intermediate wall 11 and the cup wall 9, and sealed by the sealing 12. The framework 14 is arranged axially moveable on the sleeve 13, and set at a presumed level of the finished concrete floor. The presumed level is indicated in FIG. 1 by a broken line.

In FIG. 2 the drain is shown with a drain wall 15 inserted into the channel 6. The drain wall 15 is inserted into the channel 6 between the intermediate wall 11 and the cup wall 9, and sealed by the sealing 12. The drain wall 15 is arranged axially moveable in the channel 6, and inserted into the channel until a radial flange 16 of the drain wall 15 is bearing against concrete 2 casted on the wooden floor.

The radius of the sleeve 13, at least in the upper part where the concrete 2 is casted, is larger than the radius of the drain wall 15, and the channel 6 is wider than the thickness of the drain wall 15. This makes it possible to adjust the drain wall 15 to adapt any slope of the casted concrete 2 and achieve that the flange 16 of the drain wall 15 bears against the concrete 2 at the whole circumference, even if the casted concrete was not as planned.

In FIG. 2, a membrane 17, such as a flexible sealing membrane or drain membrane is attached to the upper face of the flange 16 of the drain wall and onto the surrounding concrete floor. In this way the floor will be waterproof around the drain, and the official standards and requirements for wet rooms are met.

In a preferred embodiment, all parts of the drain are made of plastic, preferably polypropylene. The drain may also be made of a metal, such as stainless steel, or a combination of materials.

The depth of the channel should preferably be about 6 cm, as about 1 cm of the sleeve or drain wall should always be inserted into the channel, and a concrete layer on a wooden floor is normally about 3 cm. This leaves a margin of adjustment of about 2 cm.

The example above is given to illustrate the invention and should not be used to interpret the following claims limiting. The horizontal cross section of shown drain is circular, but the drain may also be rectangular, oval or any other desired shape. The scope of the invention is not limited by the example give above, but the enclosed claims. Modifications and amendments of the invention, being obvious to a person skilled of the art, should also be included in the scope of the invention.

The invention claimed is:

1. A drain comprising a cup with a fluid outlet to be connected to a conduit, wherein the cup accommodates a water trap, the cup further comprises an axial channel along the circumference, the channel is open upwards and limited by a bottom, a channel wall and a cup wall, the drain further comprises:

a removable circumferential sleeve adapted to fit into the channel, whereby the sleeve is arranged axially movable in the channel and protrudes above the cup and beyond the expected level of the floor wherein the drain is installed, a casting framework arranged around the outer circumference of the sleeve, the framework has a radial extension, a circumferential drain wall adapted to fit into the channel, whereby the drain wall is arranged axially movable in the channel, and the drain wall has an outward radial flange at an upper end, the radial extension of the flange is equal or less than the radial extension of the framework.

2. The drain according to claim 1, wherein the diameter of an upper part of the sleeve is larger than the diameter of the drain wall, the diameter of a lower part of the sleeve is equal to the diameter of the drain wall.

3. The drain according to claim 1, wherein the drain wall is arranged moveable between a first position wherein it protrudes above the cup and above an expected level of the floor where the drain is installed, and a second position wherein the flange of the drain wall is aligned with the expected level of the floor.

4. The drain according to claim 1, wherein the framework is movable axially along the drain wall or sleeve.

5. The drain according to claim 1, wherein a membrane, preferably a flexible membrane, is attached to an upper face of the radial flange of the drain wall, the membrane extends beyond the flange and covers an area around the drain.

6. The drain according to claim 1, wherein the cup has an inner flange or horizontal face which the water trap bears against.

7. The drain according to claim 1, wherein the drain further comprises an intermediate wall in the channel, the wall is fastened in a lower end to the channel wall and protrudes upwards and radially outwards until it bears against the sleeve or drain wall respectively.

8. The drain according to claim 1, wherein the cup has a radial flange at its upper end, the radial flange is to be fastened to a floor or material which the drain is to be installed in.

9. A method for installing a drain according to claim 1, comprising the following steps:

a. arranging the cup at the desired place for the drain, and connecting the outlet to a conduit, b. inserting the sleeve into the axial channel, the sleeve protrudes above the expected level of the floor, c. arranging the framework around the circumference of the sleeve, d. casting the floor, e. sliding down the sleeve until a lower part of the radial extension of the framework is below the surface of the casted floor, f. once the floor is cured, removing the sleeve and framework from drain, the framework will leave a circumferential recess in the casted floor, g. inserting the drain wall into the axial channel until the radial flange of the drain wall rests upon the circumferential recess.

10. A kit of parts for installing a drain in concrete slabs or floors, wherein the drain comprises a cup with a fluid outlet to be connected to a conduit and the cup accommodates a water trap, wherein the cup further comprises an axial channel along the circumference, whereby the channel is open upwards, the drain further comprises a removable circumferential sleeve fitting into the channel during casting of the floor, whereby the sleeve when installed in the channel protrudes above the cup and beyond the expected level of the concrete floors wherein the drain is to be installed, a casting framework arranged around the outer circumference of the sleeve, the framework has a radial extension and is movable axially along the sleeve, and a drain wall for replacing the sleeve in the channel once the floor is casted, the drain wall protrudes above the cup and has an outward radial flange at an upper end, the radial extension of the flange is equal or less than the radial extension of the framework on the sleeve.

* * * * *